US012735961B1

(12) United States Patent
Cook et al.

(10) Patent No.: US 12,735,961 B1
(45) Date of Patent: Sep. 15, 2026

(54) PERFORATING GUN SYSTEM

(71) Applicant: Halliburton Energy Services, Inc., Houston, TX (US)

(72) Inventors: Kevin Cook, Alvarado, TX (US); Christopher C. Hoelscher, Alvarado, TX (US); Matthew Mlcak, Alvarado, TX (US); Jason Cook, Alvarado, TX (US); James Wight, Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/283,671

(22) Filed: Jul. 29, 2025

(51) Int. Cl.
*E21B 43/116* (2006.01)
*E21B 43/119* (2006.01)

(52) U.S. Cl.
CPC ..... *E21B 43/116* (2013.01); *E21B 43/119* (2013.01)

(58) Field of Classification Search
CPC ..... E21B 43/116; E21B 43/1185; E21B 43/11857
See application file for complete search history.

(56) References Cited

U.S. PATENT DOCUMENTS

| | | | |
|---|---|---|---|
| 4,172,421 | A | 10/1979 | Regalbuto |
| 5,027,708 | A | 7/1991 | Gonzalez et al. |
| 9,689,223 | B2 | 6/2017 | Schacherer et al. |
| 10,077,641 | B2 | 9/2018 | Rogman et al. |
| 10,876,381 | B2 | 12/2020 | Walters et al. |
| 11,460,281 | B2 | 10/2022 | LeClair et al. |
| 11,994,008 | B2 | 5/2024 | Anthony et al. |
| 12,123,286 | B2 | 10/2024 | Dyess et al. |
| 2019/0085664 | A1* | 3/2019 | Hardesty ..... E21B 43/1185 |
| 2019/0234189 | A1* | 8/2019 | Preiss ..... E21B 23/042 |
| 2019/0366272 | A1 | 12/2019 | Eitschberger et al. |
| 2020/0048996 | A1* | 2/2020 | Anthony ..... E21B 43/119 |
| 2022/0258103 | A1* | 8/2022 | Eitschberger ..... F42B 3/10 |
| 2023/0366299 | A1* | 11/2023 | Badii ..... E21B 43/1185 |
| 2024/0125214 | A1 | 4/2024 | Eitschberger |

FOREIGN PATENT DOCUMENTS

| | | | |
|---|---|---|---|
| WO | 2019055187 | A1 | 3/2019 |
| WO | 2021150252 | A1 | 7/2021 |
| WO | 2022256817 | A1 | 12/2022 |

OTHER PUBLICATIONS

International Search Report and Written Opinion mailed Apr. 24, 2026 in PCT/US2025/041838.

* cited by examiner

*Primary Examiner* — David Carroll
(74) *Attorney, Agent, or Firm* — The Hilton Firm PLLC

(57) ABSTRACT

A perforating gun with a primary housing and secondary housing. The primary housing has two cutouts along its axial length. The secondary housing has a flexing element and a spring and is configured to insert into the primary housing. The flexing element has a protrusion on an exterior surface and the protrusion has an angled surface and extends radially outward from the secondary housing. The protrusion is shaped to slot into one of the cutouts when the secondary housing is inserted into the primary housing. The protrusion slots into the first of the cutouts to disarm the perforating gun. The protrusion slots into the second of the cutouts to arm the perforating gun. The perforating gun additionally includes a detonator coupled to an interior surface of the secondary housing.

20 Claims, 18 Drawing Sheets

PERFORATING GUN SYSTEM

TECHNICAL FIELD

The present disclosure relates generally to perforating operations, and more particularly, to the use of a perforating gun having a primary and secondary housing which may be decoupled to allow for safe transport and storage of the perforating gun.

BACKGROUND

Perforating operations may be used to form a channel in the casing or liner of an oil well to connect the wellbore conduit to a surrounding reservoir. Generally, perforating may be performed during the completion of the well and may involve introducing perforating guns into the wellbore at a desired depth and then firing to perforate the casing or liner. For some perforating operations, it may be desirable to transport a perforating gun to the wellsite from an offsite location or to store the perforating gun at the wellsite. Generally, the perforating gun may not be transported or stored with a detonator or initiator installed. A detonator or initiator assembly may be transported and stored separately and then installed in the perforating gun when needed. This approach may mitigate the risk of prematurely arming the perforating gun.

The use of a perforating gun may be an important part of a wellbore operation. The present disclosure provides improved perforating guns for use in a perforating operation.

BRIEF DESCRIPTION OF THE DRAWINGS

Illustrative examples of the present disclosure are described in detail below with reference to the attached drawing figures, which are incorporated by reference herein, and wherein.

Figure 1A:
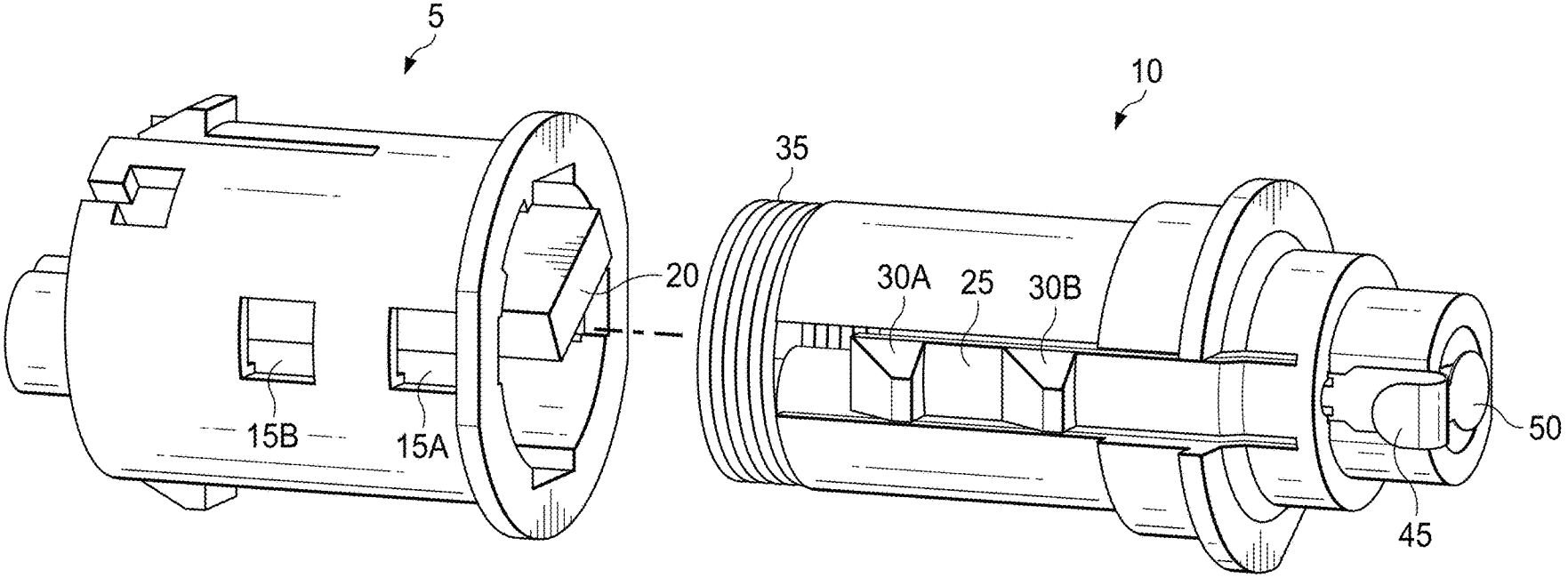
FIG. 1A is an illustration of a perspective drawing of a decoupled primary housing and secondary housing in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to perforating operations, and more particularly, to the use of a perforating gun having a primary and secondary housing which may be decoupled to allow for safe transport and storage of the perforating gun.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present invention. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms "uphole" and "downhole" may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

The terms "upstream" and "downstream" may be used to refer to the location of various components relative to one another in regards to the flow of a sample through said components. For example, a first component described as upstream from a second component will encounter a sample before the downstream second component encounters the sample. Similarly, a first component described as being downstream from a second component will encounter the sample after the upstream second component encounters the sample.

As used herein the weight/volume ("w/v") is to be understood to mean the weight of a solute (in units of grams) divided by the volume of solution (in units of milliliters), and the weight/volume percentage ("% w/v") is to be understood to mean the grams/milliliters multiplied by 100.

The present disclosure relates generally to perforating operations, and more particularly, to the use of a perforating gun having a primary and secondary housing which may be decoupled to allow for safe transport and storage of the perforating gun. Advantageously, the perforating gun comprises a primary housing and secondary housing. The secondary housing is configured to insert into the primary housing. The secondary housing comprises a flexing element with at least one protrusion which slots into one of the cutouts in the body of the primary housing. The primary housing comprises two cutouts. When the protrusion is slotted into the first of the cutouts, the perforating gun is in its disarmed state and may be transported or stored. When the protrusion is slotted into the second of the cutouts, the perforating gun is in its armed state and may be used to perform a perforating operation in a wellbore. The movement of the secondary housing into the primary housing allows for the perforating gun to shift from the disarmed state to the armed state, which allows for the perforating gun to be transported and/or stored with the detonator installed and wired into the perforating gun. Optionally, the switch may also be installed in the primary or secondary housing. The perforating gun does not require assembly and installation of the detonator and/or switch when desired for use nor does it require the removal of the detonator and/or switch after use. Instead, the perforating gun may be shifted between armed and disarmed states without removal of these components. As a further advantage, the perforating gun comprises a spring which pushes the secondary housing away from the direction of insertion of the primary housing. This opposing force allows for shifting the perforating gun to its disarmed state by disengaging the protrusion from the second cutout thereby allowing the spring to push the secondary housing away from the primary housing so that the protrusion may slot into the first cutout and lock the perforating gun into its disarmed state. As a still further advantage, the protrusion is multi-surfaced and is shaped such that when the protrusion is slotted into a cutout, the protrusion prevents movement of the secondary housing in a direction opposite of the direction of insertion of the secondary housing. The shape of the protrusion also allows for movement of the secondary housing in the direction of insertion of the secondary housing such that the secondary housing can be inserted deeper into the primary housing. The multi-surfaced protrusion allows for axial translation of the secondary housing into the primary housing and also for rotation of the secondary housing in the primary housing. Advantageously, the secondary housing may comprise a detonator housing that is one continuous piece with the secondary housing or alternatively may comprise a detonator housing that is a separate component from the secondary housing. Further, the perforating gun may comprise a switch disposed within the primary or secondary housing or the switch may be disposed external to the primary or secondary housing, for example, in the charge tube.

The perforating gun may be used in any perforating operation in a wellbore. For example, the perforating gun may be used during any part of the completion process when perforation of a casing, liner, or other wellbore conduit is desired. The perforating gun may be of particular use when transportation and/or storage of the perforating gun will be required to conduct the perforating operation.

Figure 1B:
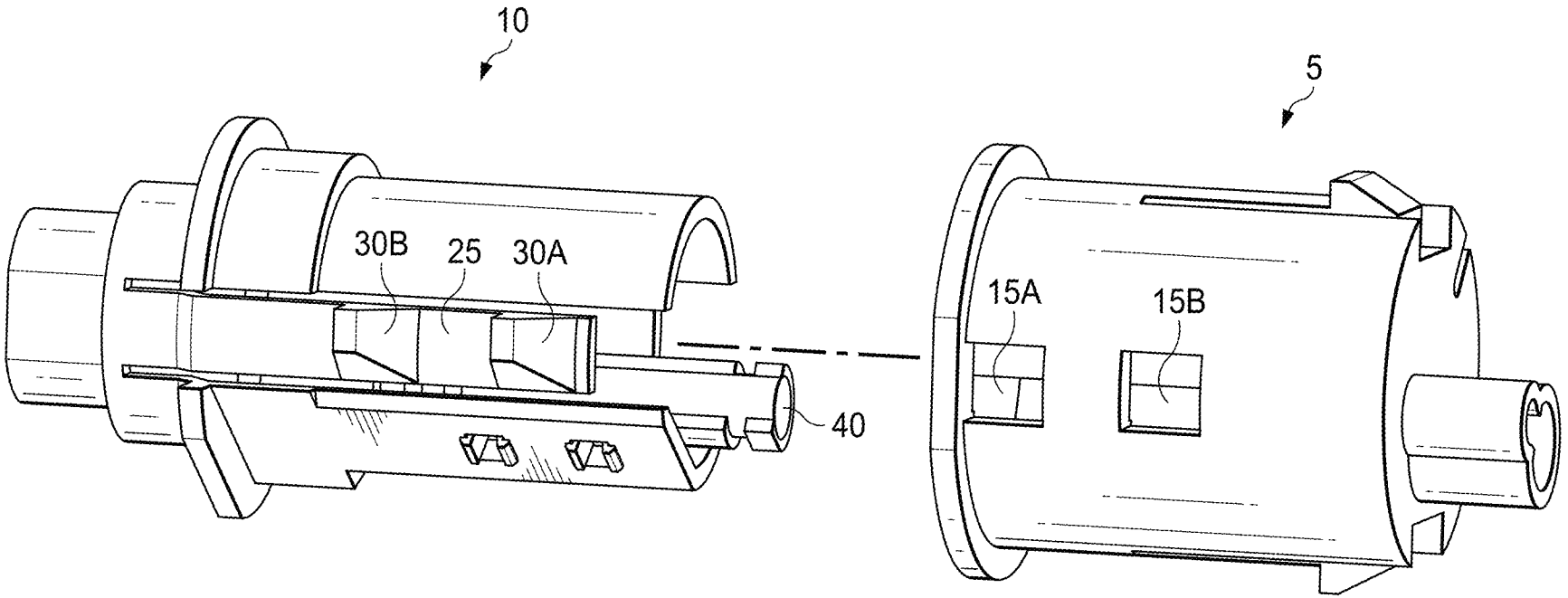
FIG. 1B illustrates another view of the decoupled primary housing and secondary housing in accordance with one or more examples described herein.

FIG. 1A illustrates a perspective drawing of a decoupled primary housing 5 and secondary housing 10. FIG. 1B illustrates another view of the decoupled primary housing 5 and secondary housing 10. The secondary housing 10 is insertable into the primary housing 5. The primary housing 5 comprises two cutouts 15A and 15B which are cut through the body of the primary housing 5 and are spaced apart along the axial length of the primary housing 5. The primary housing 5 is also illustrated as comprising a switch 20 disposed in the interior of the primary housing 5. In some alternative examples, the switch 20 may be located in the secondary housing 10 or externally to the primary or secondary housing 5, 10 with the corresponding wiring running into the interior of the primary or secondary housing 5, 10. The secondary housing 10 comprises a flexing element 25 extending along an axial length of the body of the secondary housing 10. The flexing element 25 is configured to depress to flex radially inward of the body of the secondary housing 10 during insertion of the secondary housing 10 into the primary housing 5. The flexing element contains two multi-surfaced protrusions 30A and 30B on its exterior surface that extend radially outward away from the secondary housing 10. In some alternative embodiments, only one protrusion 30 may be disposed on the flexing element 25. The protrusions 30A and 30B each comprise an angled surface that is shaped to slot into one of the cutouts 15A and 15B when the secondary housing 10 is inserted into the primary housing 5.

In the illustration of FIG. 1A, to prepare the perforating gun, the secondary housing 10 is inserted into the primary housing 5. During insertion, the flexing element 25 flexes inward of the secondary housing 10 to allow the leftmost protrusion 30A to proceed into the primary housing 5 where it slots into the rightmost cutout 15A thereby placing the perforating gun in its disarmed state. To arm the perforating gun, secondary housing 10 is inserted deeper into primary housing 5 such that flexing element 25 flexes inward to allow protrusion 30A to dislodge from cutout 15A and then to move further forward into primary housing 5 to slot into the second cutout 15B. In the armed state, protrusion 30B will be moved to slot into cutout 15A. As used herein, "armed" may refer to ballistically armed, electrically armed, or both ballistically and electrically armed depending on the specific explosive and electronic components used for the perforating gun.

The secondary housing additionally comprises a spring 35 which is visible in FIG. 1A but removed for clarity of illustration in FIG. 1B. The spring 35 is disposed on the end of the secondary housing 10 that is first inserted into the primary housing 5. The spring 35 presses against an interior surface of the primary housing 5 when the secondary housing 10 is inserted into the primary housing 5 such that the spring 35 applies a force against the primary housing 5. The spring 35 provides resistance to the insertion of the secondary housing 10 to prevent premature arming of the perforating gun as well as provides the force to disarm the perforating gun from its armed state when the protrusions 30 are disengaged from a respective cutout 15.

The protrusions 30 are multi-surfaced with angled faces that are shaped such that when slotted into a cutout, protrusions 30 prevent the reverse movement of the secondary housing 10 in the direction opposite of the direction of insertion of the secondary housing 10, that is, the protrusions resist the force applied by the spring 35. Protrusions 30 are also shaped such that when a protrusion 30 is slotted into a cutout 15, the protrusion 30 allows for further movement of the secondary housing 10 in the direction of insertion of the secondary housing 10 such that the secondary housing 10 can be pushed forward to be inserted deeper into the primary housing 5. More particularly, the protrusions are shaped to be dislodged from the cutouts when pushed axially forward into the primary housing 5. Additionally, the protrusions 30 are also shaped to allow rotational movement of the secondary housing 10 within the primary housing 5. This rotational movement may be used to disarm the perforating gun from its armed state by rotating the secondary housing 10 until the protrusions 30 are disengaged from the cutouts 15. The force applied by the spring 35 to the primary housing 5 then pushes the secondary housing 10 away from primary housing 5 when the protrusions are disengaged.

With continued reference to FIGS. 1A and 1B, the secondary housing 10 additionally comprises a detonator 40. The detonator 40 couples to a detonating cord (not illustrated) that may be inserted into the end of primary housing 5 opposite that of the entrance in which the secondary housing 10 is inserted. When arming the perforating gun, secondary housing 10 is inserted deeper into the primary housing 5 until protrusion 30A slots into cutout 15B which allows for the detonator 40 of secondary housing 10 to couple to the detonating cord inserted into primary housing 5. When the detonator 40 and the detonating cord are connected, the perforating gun is armed and may be fired. In this orientation, the spring 35 is also compressed and the slotting of protrusion 30A into cutout 15B prevents the spring 35 from pushing the primary housing 5 away from the secondary housing 10.

With continued reference to FIG. 1A, the secondary housing 10 additionally comprises an electrical ground 45 on the end opposite the end of insertion as well as an electrical connector 50 on the same end. The electrical connector 50 may electrically connect the perforating gun to an adjacent element such as a second perforating gun and allow for conveyance of the electrical firing signal to fire the armed perforating gun when desired.

It should be clearly understood that the example primary and secondary housings illustrated by FIGS. 1A and 1B are merely a general application of the principles of this disclosure in practice, and a wide variety of other examples are possible. Therefore, the scope of this disclosure is not limited in any manner to the details of FIGS. 1A and 1B as described herein.

Figure 2:
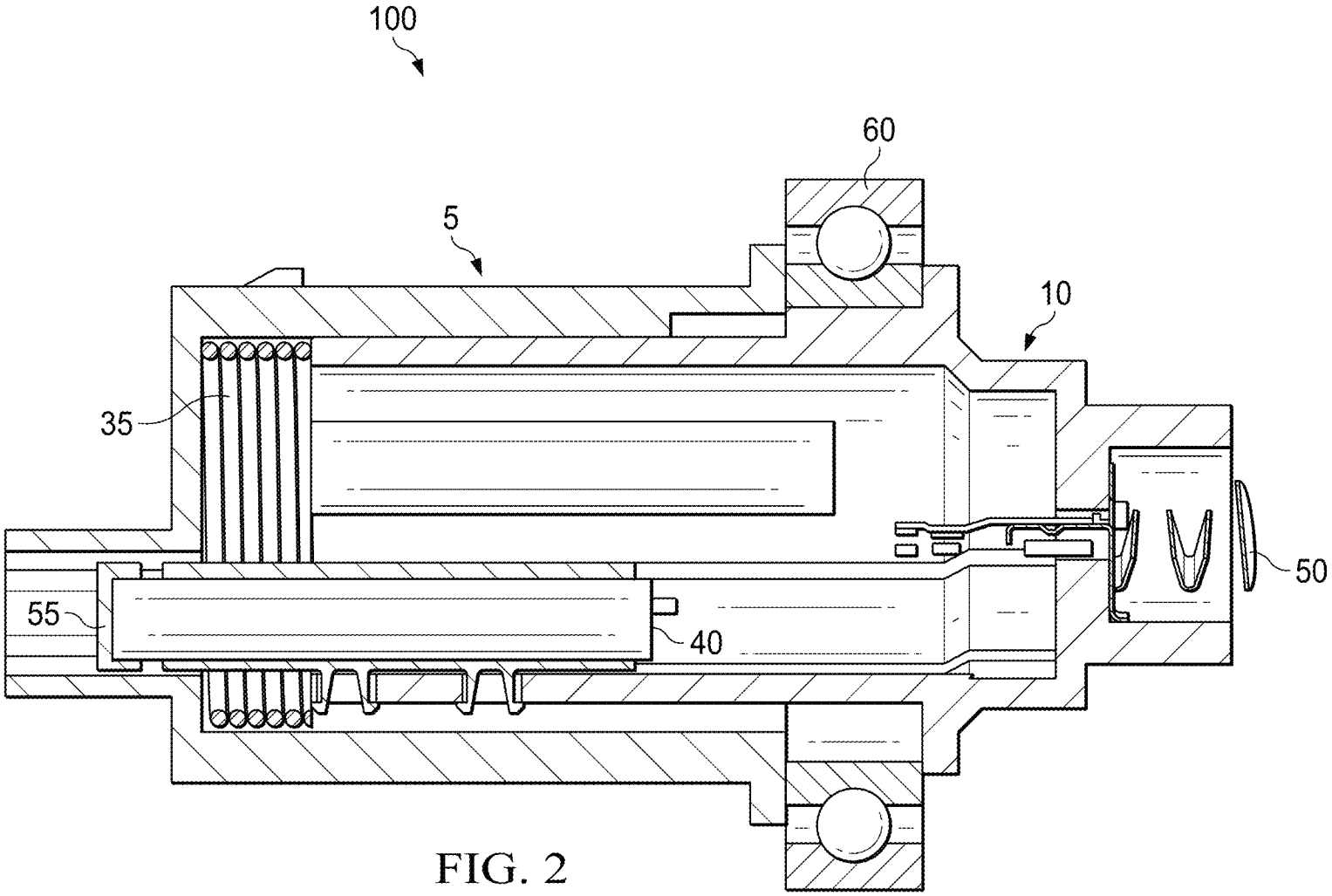
FIG. 2 is a cross-section of a perforating gun in the armed state in accordance with one or more examples described herein.

FIG. 2 is a cross-section of a perforating gun 100 in the armed state. In the illustration of FIG. 2, the secondary housing 10 is inserted into the primary housing 5 until the protrusion of the flexing element reaches the cutoff for the armed position. For clarity of illustration, the flexing element and cutoffs are not illustrated in this Figure. In the armed position, the spring 35 is compressed and the detonator 40 couples to the detonating cord (not illustrated) which is inserted into the opposing end of the primary housing 5. A bearing 60 is also illustrated on the exterior of the secondary housing 10. The bearing 60 may assist in reducing friction forces from contact faces. Additionally, the detonator 40 is contained within a detonator housing 55. In this specific example, the detonator housing 55 is shown as a separate component that is coupled to the secondary housing 10. However, in some examples the detonator housing may be one continuous piece with the secondary housing 10, for example, it may be a molded part of the secondary housing 10.

It should be clearly understood that the example perforating gun illustrated by FIG. 2 is merely a general application of the principles of this disclosure in practice, and a wide variety of other examples are possible. Therefore, the scope of this disclosure is not limited in any manner to the details of FIG. 2 as described herein.

Figure 3:
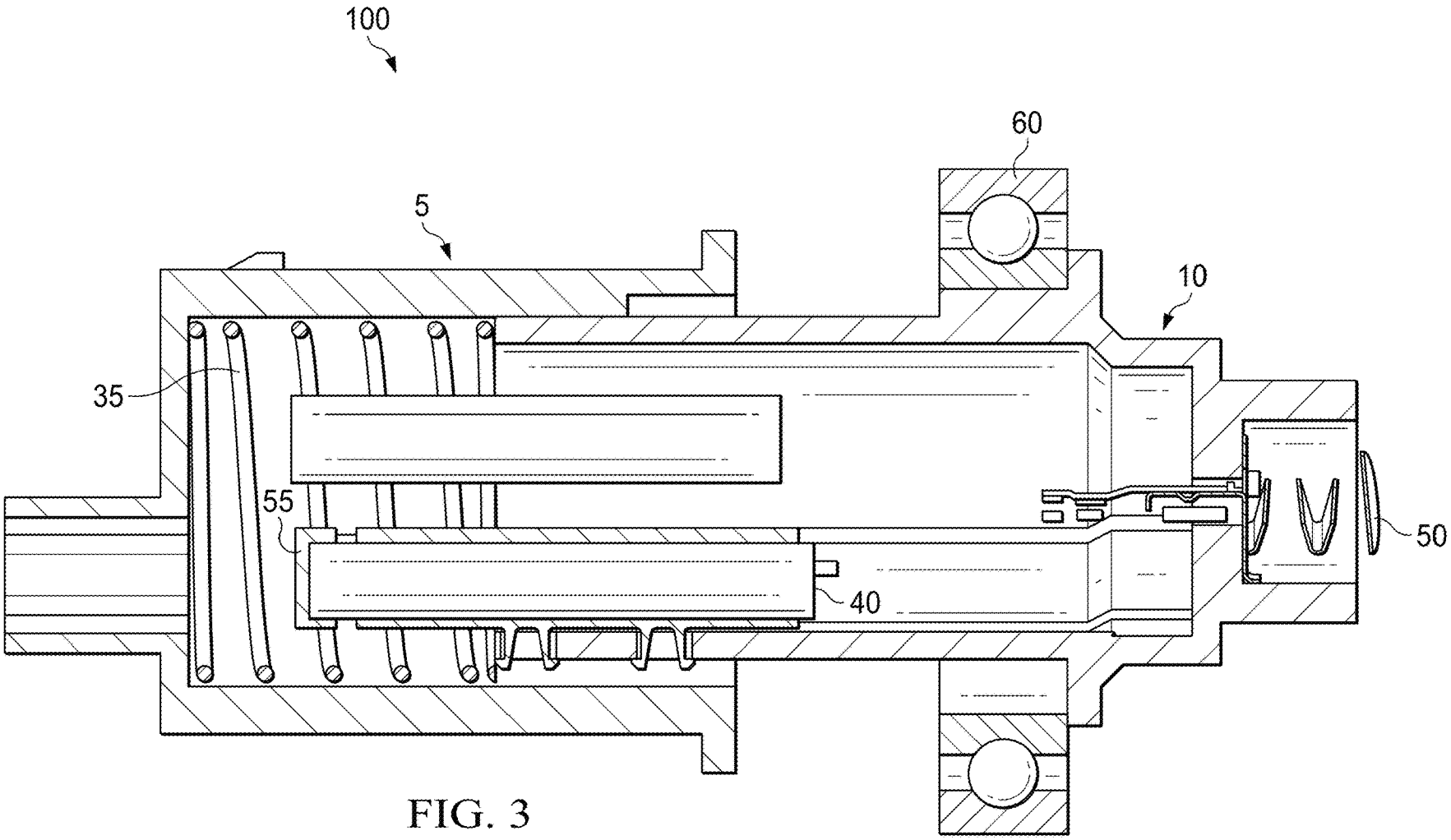
FIG. 3 is a cross-section of a perforating gun in the disarmed state in accordance with one or more examples described herein.

FIG. 3 is a cross-section of a perforating gun 100 in the disarmed state. In the illustration of FIG. 3, the secondary housing 10 is inserted into the primary housing 5 until the protrusion of the flexing element reaches the cutout for the disarmed position. In this position, the secondary housing 10 is coupled to the primary housing 5, but remains partially uninserted such that the detonator 40 does not contact the detonating cord. For clarity of illustration, the flexing element and cutouts are not illustrated in this Figure. In the disarmed position, the spring 35 is either not compressed or only partially compressed and the detonator 40 remains decoupled from the detonating cord (not illustrated). Bearing 60 is disposed on the exterior of the secondary housing 10. Detonator 40 is contained within the detonator housing 55. In this specific example, the detonator housing 55 is shown as a separate component that is coupled to the secondary housing 10. However, in some examples the detonator housing may be one continuous piece with the secondary housing 10, for example, it may be a molded part of the secondary housing 10.

It should be clearly understood that the example perforating gun illustrated by FIG. 3 is merely a general application of the principles of this disclosure in practice, and a wide variety of other examples are possible. Therefore, the scope of this disclosure is not limited in any manner to the details of FIG. 3 as described herein.

Figure 4:
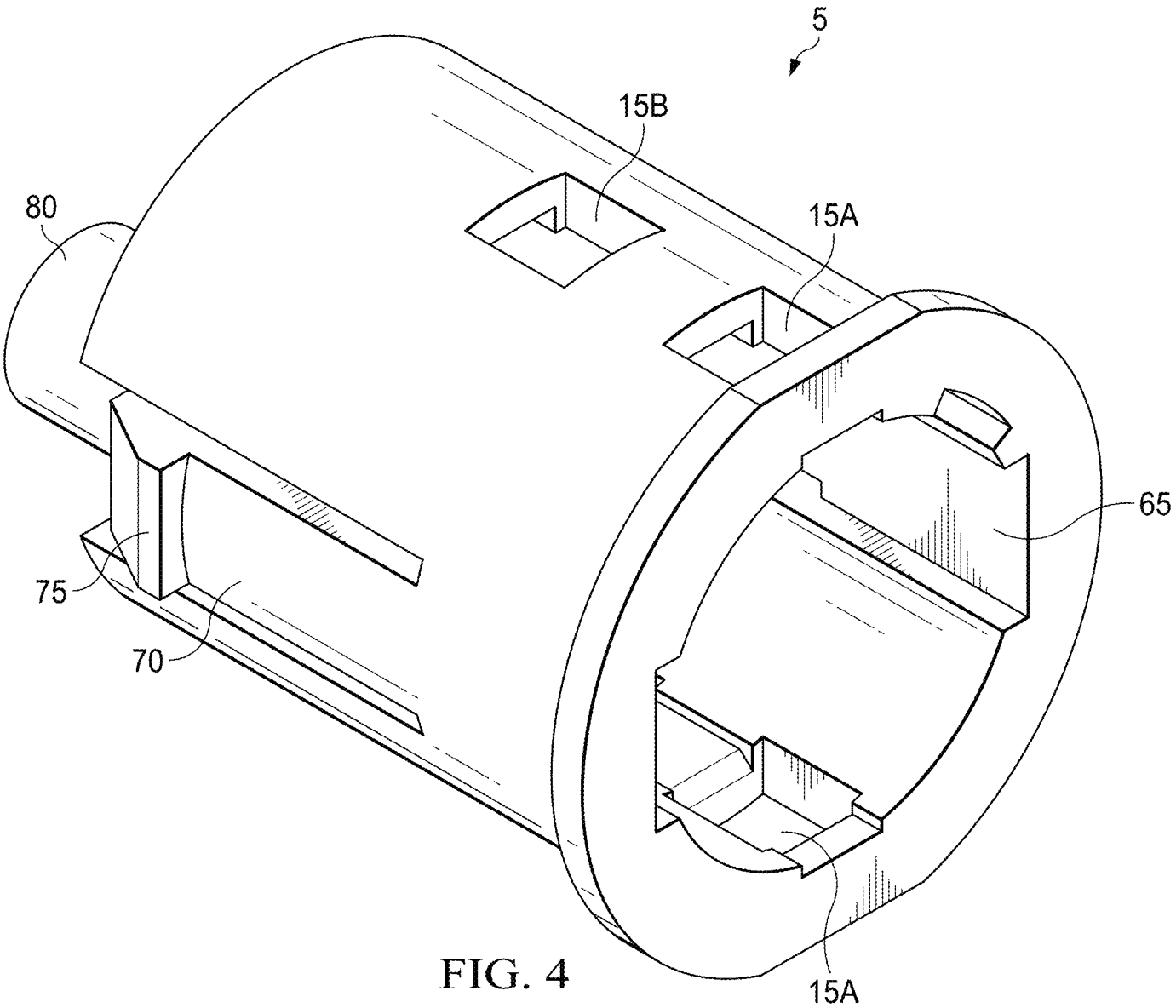
FIG. 4 is a perspective illustration of the primary housing in accordance with one or more examples described herein.

FIG. 4 is a perspective illustration of the primary housing 5. The primary housing 5 comprises an opening 65 for insertion of the secondary housing (not illustrated). Additionally, primary housing 5 comprises two cutouts, 15A and 15B, cut through the body of the primary housing 5 and spaced apart along the axial length of the primary housing 5.

The cutouts 15 are shaped to allow for the slotting of the protrusions of the flexing element of the secondary housing. The primary housing 5 additionally comprises a flexing element 70 extending along an axial length of the body of the primary housing 5. The flexing element 70 is configured to depress and flex radially inward of the body of the primary housing 5. The flexing element contains one protrusion 75 on its exterior surface that extends radially outward away from the primary housing 5. In some alternative embodiments, two or more protrusions 75 may be disposed on flexing element 70. Protrusion 75 comprises an angled surface that is shaped to slot into a cutout from a surrounding structure, for example, a charge tube. It is to be understood that other mechanisms for locking the perforating gun into a surrounding structure may be used in alternative examples. The end of the primary housing 5 opposite opening 65 comprises a detonating cord insert tube 80. The detonating cord insert tube 80 is a structure extending from the primary housing 5 and comprises an opening for a detonating cord to be inserted. The detonating cord may extend into the interior of the primary housing 5 and positioned such that it may couple to the detonator to arm the perforating gun.

It should be clearly understood that the example primary housing illustrated by FIG. 4 is merely a general application of the principles of this disclosure in practice, and a wide variety of other examples are possible. Therefore, the scope of this disclosure is not limited in any manner to the details of FIG. 4 as described herein.

Figure 5:
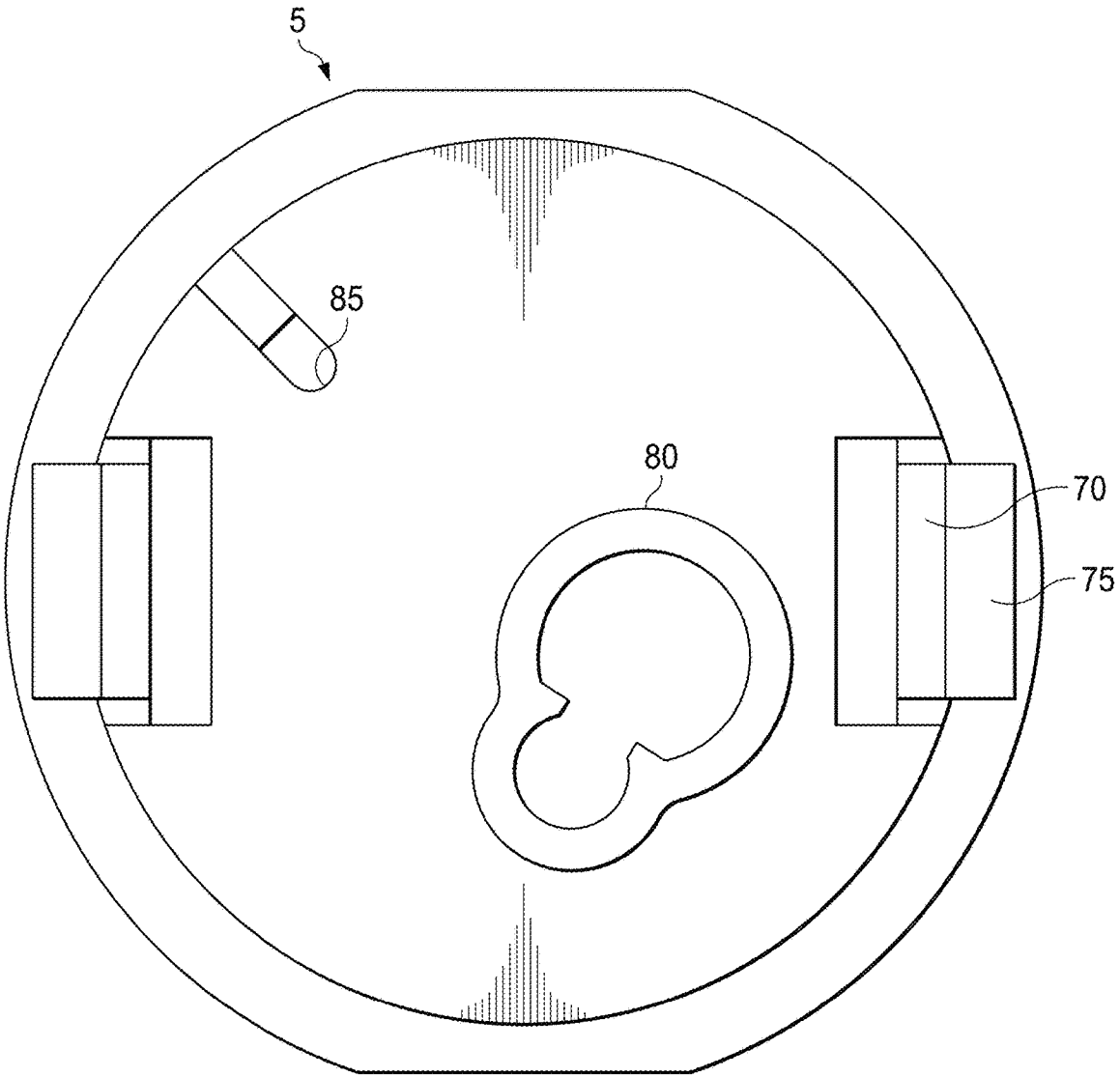
FIG. 5 is a cross-section illustration of the primary housing in accordance with one or more examples described herein.

FIG. 5 is a cross-section illustration of the primary housing 5. In this illustration, there are two flexing elements 70 visible with their corresponding protrusions 75 on their exterior surfaces. Additionally, detonating cord insert tube 80 and the opening for the corresponding detonating cord opening are visible. Additionally, a power wire cutout 85 is visible which provides a space for the insertion of a power wire into the interior of the primary housing 5.

It should be clearly understood that the example primary housing illustrated by FIG. 5 is merely a general application of the principles of this disclosure in practice, and a wide variety of other examples are possible. Therefore, the scope of this disclosure is not limited in any manner to the details of FIG. 5 as described herein.

Figure 6:
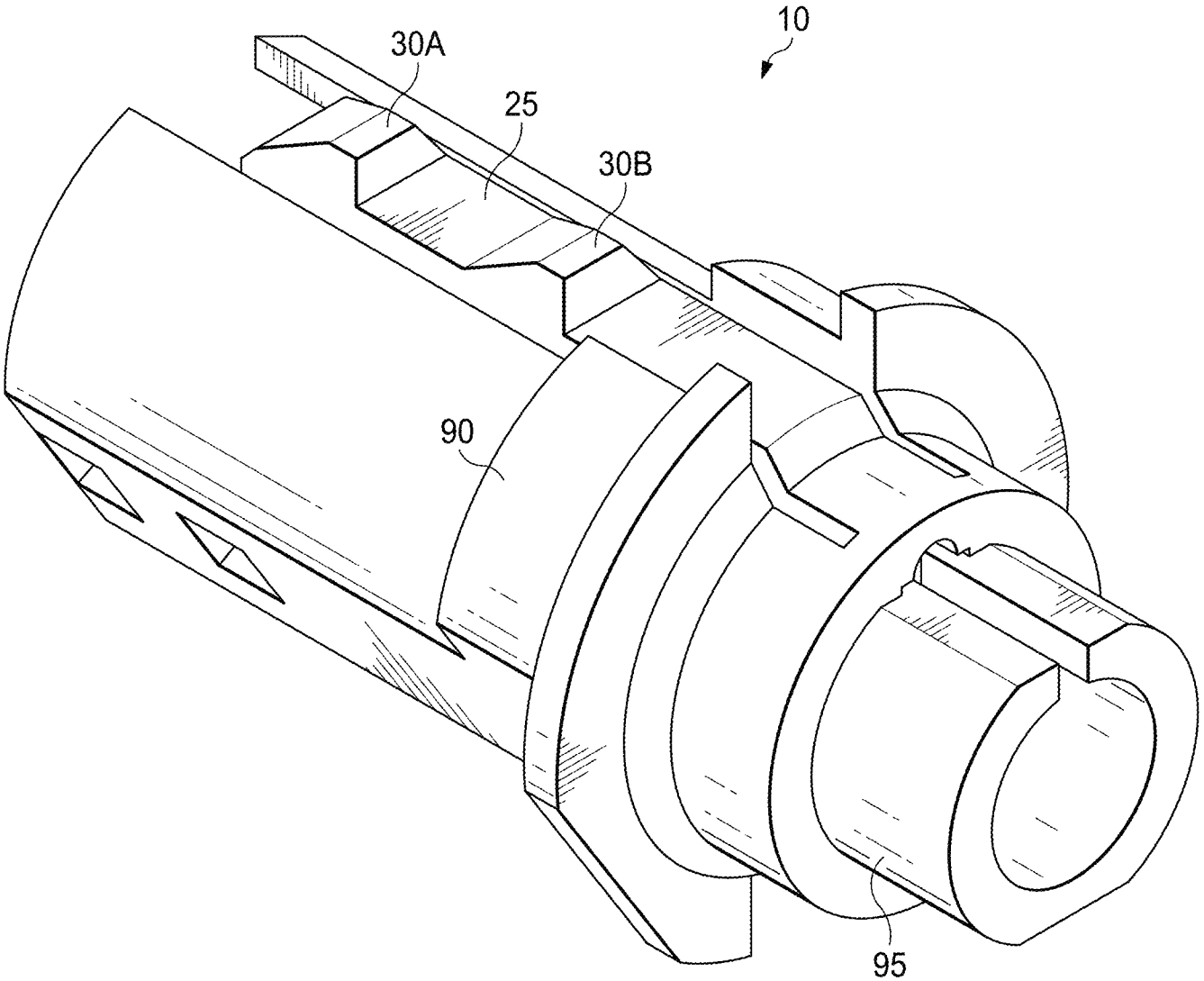
FIG. 6 is a perspective illustration of one example of the secondary housing in accordance with one or more examples described herein.

FIG. 6 is a perspective illustration of one example of the secondary housing 10. The secondary housing 10 comprises a flexing element 25 extending along an axial length of the body of the secondary housing 10. The flexing element 25 is configured to depress and flex radially inward of the body of the secondary housing 10. In the example of FIG. 6, the flexing element contains two protrusions 30A and 30B on its exterior surface. The protrusions 30 extend radially outward away from the secondary housing 10. The protrusions 30 are multi-surfaced and comprise angled faces shaped to slot into a cutout of the primary housing. The secondary housing 10 also comprises bearing surfaces where optional bearings may be installed. Bearing surface 90 is disposed proximate the flexing element 25. Bearing surface 95 is disposed proximate the opening for the electrical connector. The bearings, when used, may resist friction forces from contact faces. The bearings may also allow for resistance free rotation of the internal charge assembly to rotate freely when used in internally oriented perforating gun systems. The bearing may also be used to provide a larger resistance to axial forces so that the other component parts to not see significant deflection or breaking during coupling of other systems such as secondary perforating guns. Examples of bearings may include thrust bearings, needle bearings, angular contact bearings, journal bearings, taper roller bearings, standard roller bearings, and the like.

It should be clearly understood that the example secondary housing illustrated by FIG. 6 is merely a general application of the principles of this disclosure in practice, and a wide variety of other examples are possible. Therefore, the scope of this disclosure is not limited in any manner to the details of FIG. 6 as described herein.

Figure 7:
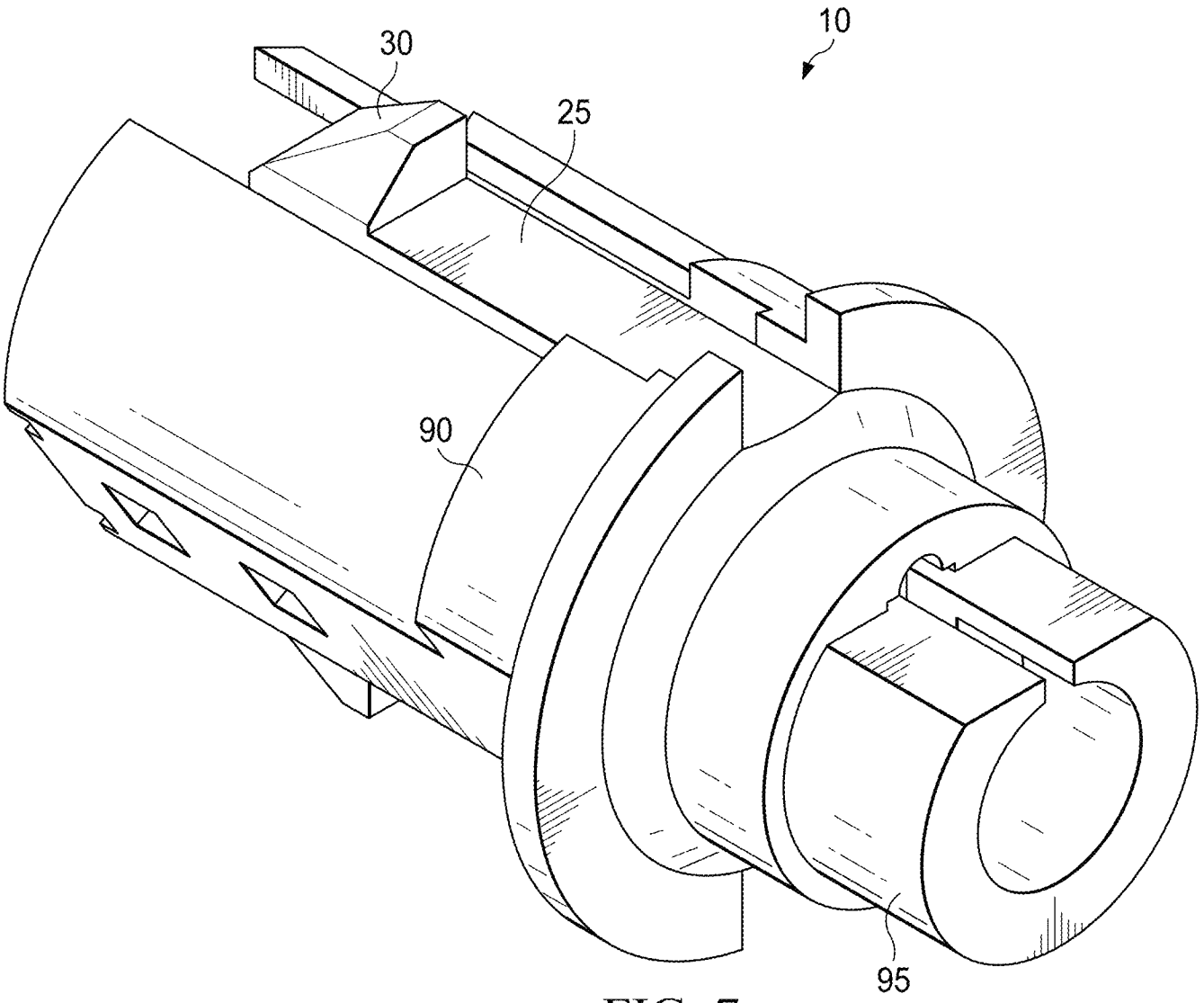
FIG. 7 is a perspective illustration of another example of the secondary housing in accordance with one or more examples described herein.

FIG. 7 is a perspective illustration of another example of the secondary housing 10. In this example, flexing element 25 contains only one protrusion 30 on its exterior surface. The protrusion 30 extends radially outward away from the secondary housing 10. The protrusion 30 is multi-surfaced and comprise angled faces shaped to slot into a cutout of the primary housing.

It should be clearly understood that the example secondary housing illustrated by FIG. 7 is merely a general application of the principles of this disclosure in practice, and a wide variety of other examples are possible. Therefore, the scope of this disclosure is not limited in any manner to the details of FIG. 7 as described herein.

Figure 8:
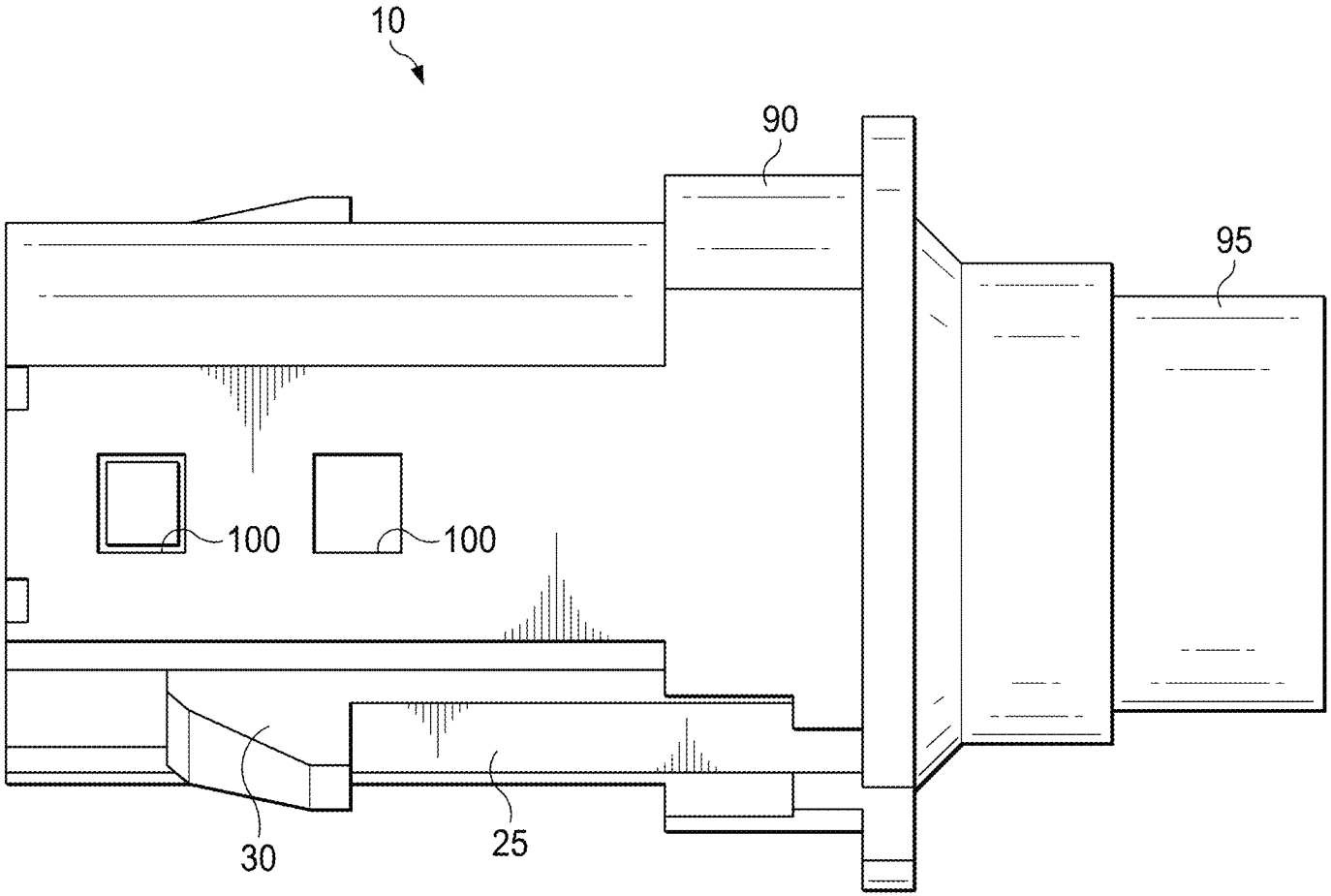
FIG. 8 is a perspective illustration of another example of the secondary housing in accordance with one or more examples described herein.

FIG. 8 is a perspective illustration of an example of the secondary housing 10. In the illustration of FIG. 8, the detonator housing cutouts 100 are illustrated. The detonator housing cutouts 100 are cut through the body of the secondary housing 10 and are spaced apart along the axial length of the secondary housing 10. Although two cutouts 100 are illustrated, less than or more than two cutouts 100 may be provided as desired. The cutouts 100 are shaped to allow for the insertions of attachment elements of the detonator housing (not illustrated). The cutouts 100 are optional and are not used in examples of the secondary housing 10 which comprise a detonator housing molded into and continuous with the secondary housing 10.

It should be clearly understood that the example secondary housing illustrated by FIG. 8 is merely a general application of the principles of this disclosure in practice, and a wide variety of other examples are possible. Therefore, the scope of this disclosure is not limited in any manner to the details of FIG. 8 as described herein.

Figure 9A:
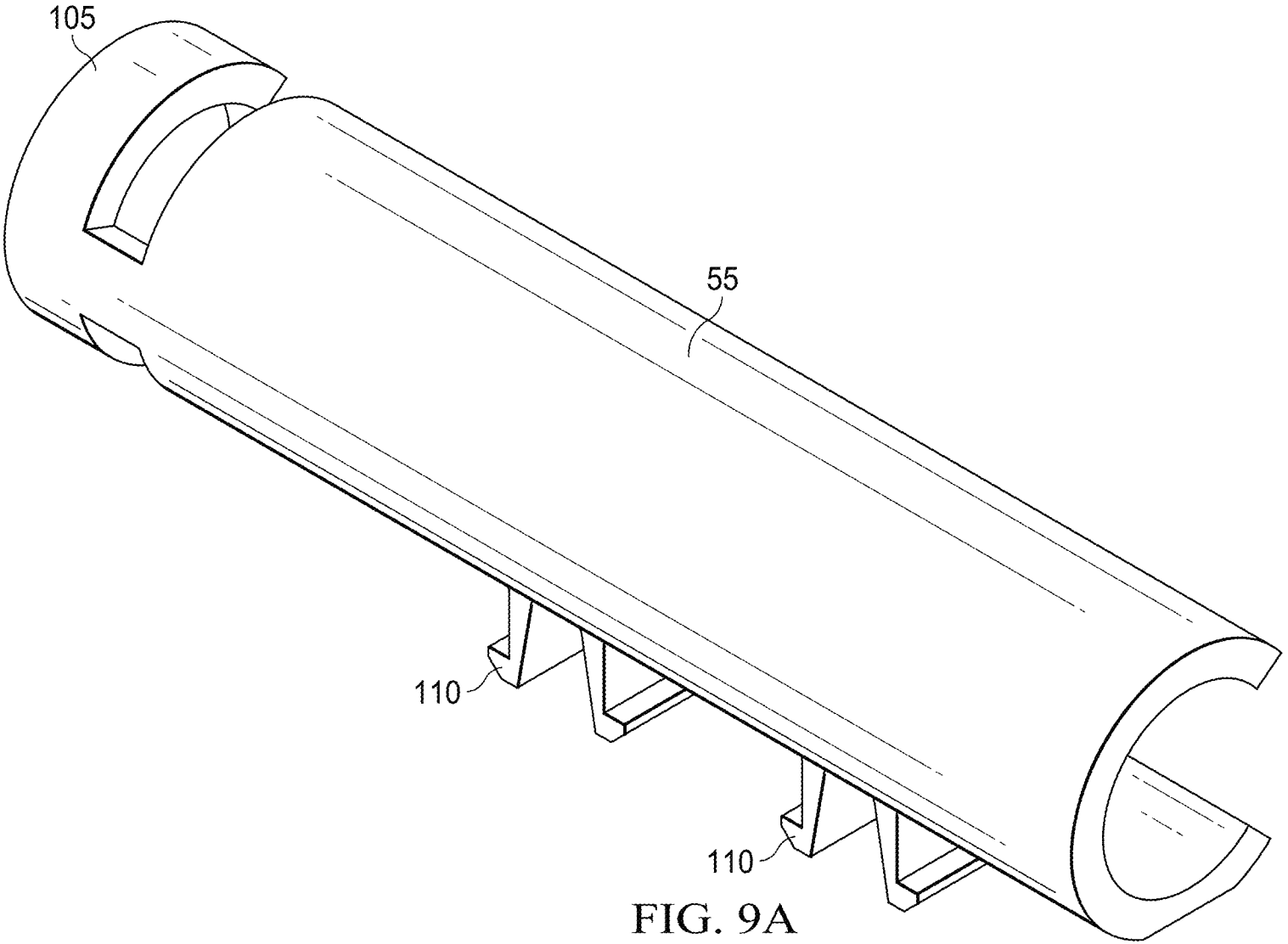
FIG. 9A is a perspective illustration of an example detonator housing in accordance with one or more examples described herein.
Figure 9B:
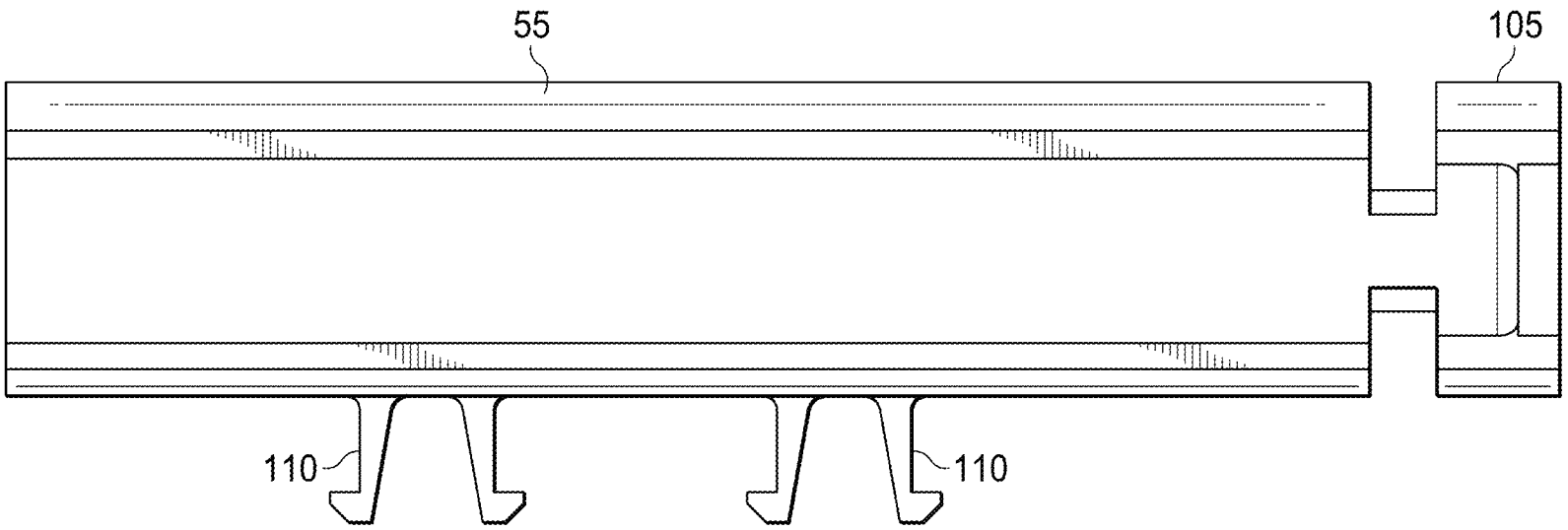
FIG. 9B is a cross-section illustration of the detonator housing in accordance with one or more examples described herein.
Figure 9C:
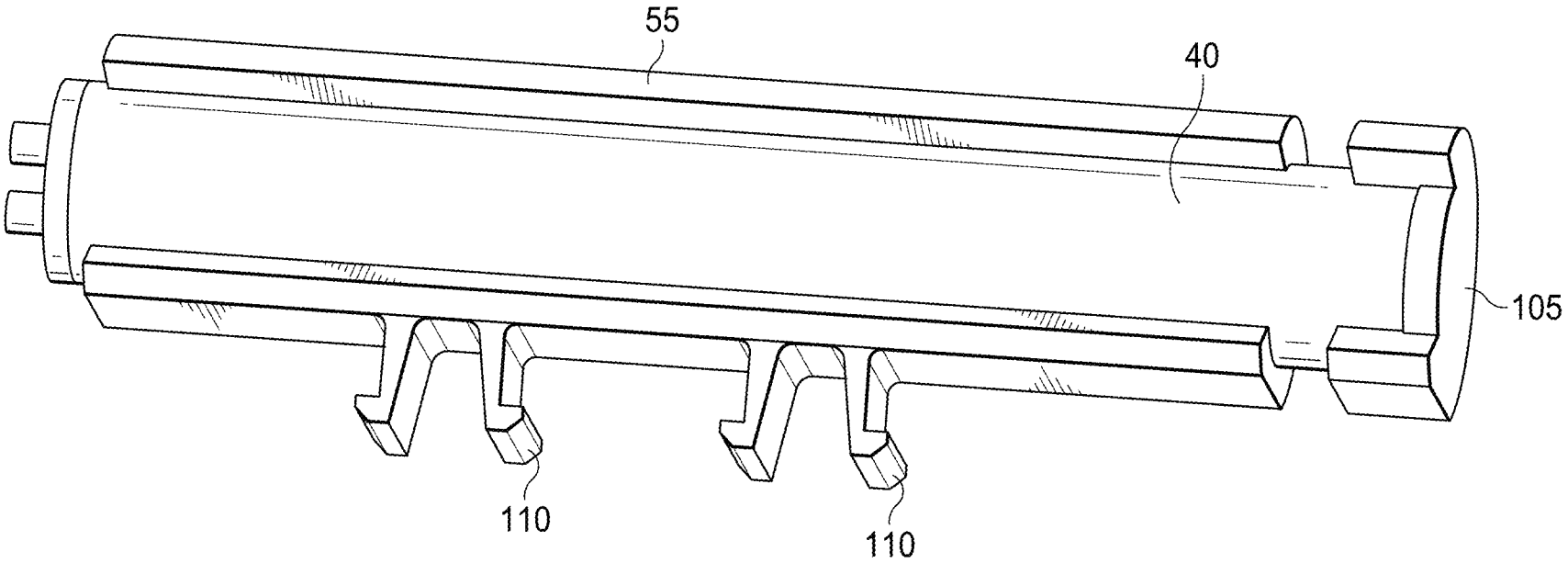
FIG. 9C is an illustration of the detonator housing when the detonator is installed within in accordance with one or more examples described herein.

FIG. 9A is a perspective illustration of an example detonator housing 55. Attachment elements 110 may be used to attach the detonator housing 40 to the interior of the secondary housing via cutouts in the secondary housing, for example, as shown in FIG. 8. FIG. 9B is a cross-section illustration of the detonator housing 55. FIG. 9C is an illustration of the detonator housing 55 when the detonator 40 is installed within. Attachment elements 110 may be collets, clips, or other mechanisms sufficient to lock the detonator housing into the interior of the secondary housing. The detonator housing also comprises an endcap 105 which may assist in preventing unintended detonation. The endcap 105 provides a sufficient barrier to the ballistic transfer of the detonator 40 to the detonating cord. The confinement of the endcap 105 directs the detonator output to the area where the detonator 40 is exposed. The ballistic transfer is defined by an all-fire and no-fire sensitivity range. This sensitivity range is controlled by separation distance and barrier configurations of the ballistic components. The barrier provided by the endcap 105 on the detonator housing 55 is designed to enhance the reliability of both the unarmed (no-fire) position and the armed (all-fire) position.

It should be clearly understood that the example detonator housing illustrated by FIGS. 9A-9C are merely a general application of the principles of this disclosure in practice, and a wide variety of other examples are possible. Therefore, the scope of this disclosure is not limited in any manner to the details of FIGS. 9A-9C as described herein.

Figure 10:
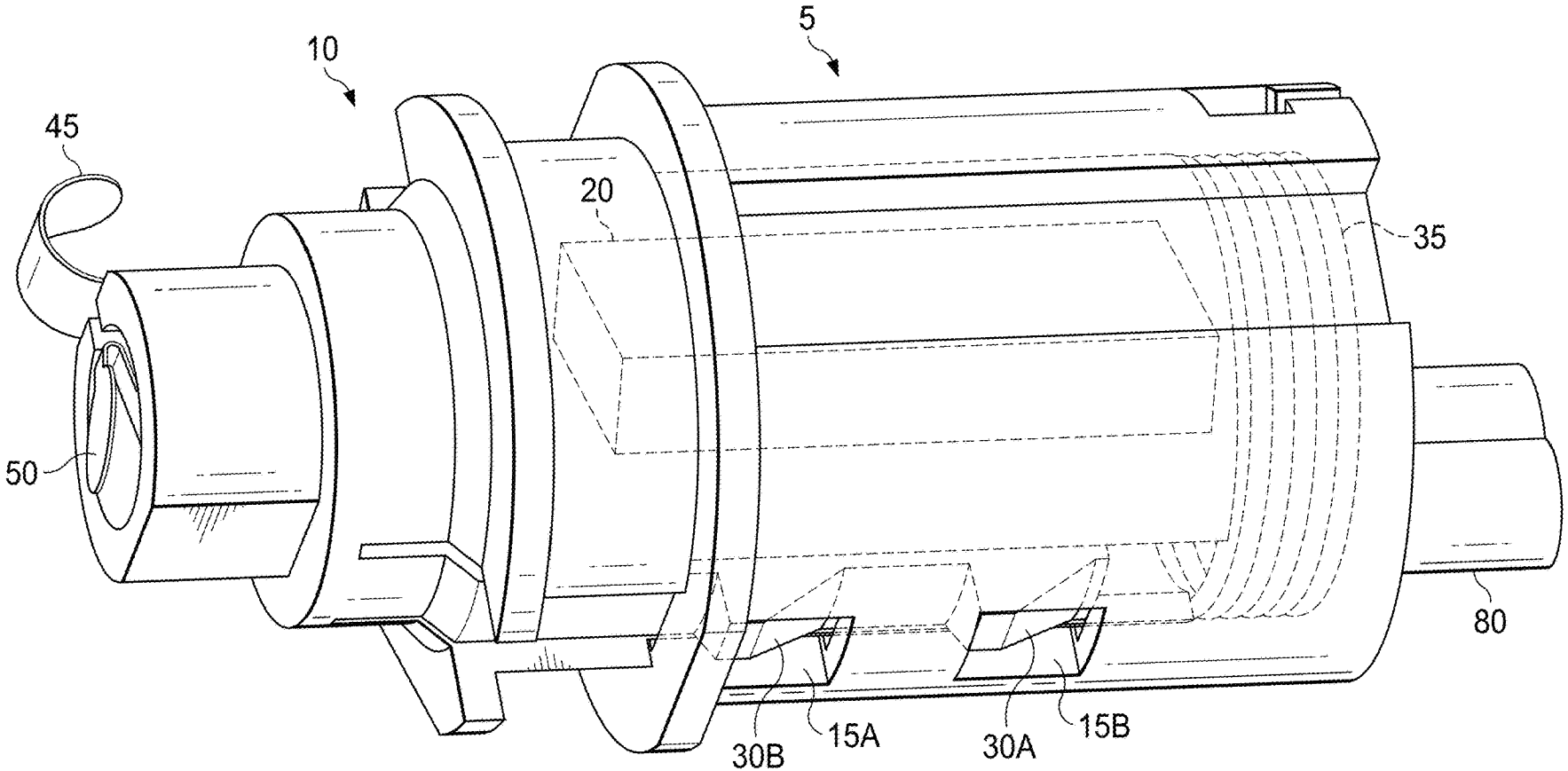
FIG. 10 is an illustration of the perforating gun when the secondary housing is installed within the primary housing to arm the perforating gun in accordance with one or more examples described herein.

FIG. 10 is an illustration of the perforating gun when the secondary housing 10 is installed within the primary housing 5 to arm the perforating gun. In this configuration the protrusion 30A is slotted in cutout 15B and protrusion 30B is slotted in cutout 15A. In this specific example, two protrusions are used on the flexing element of the secondary housing 10. Other examples may utilize a flexing element having one protrusion. A switch 20 is present on the interior of the secondary housing 10. In alternative examples, the switch 20 may be disposed in the primary housing 5, the charge tube, or other location exterior to the primary or secondary housing 5, 10. Additionally, the electrical connector 50 and the electrical ground 45 are disposed at the end of the secondary housing 10 opposite of the insertion end.

It should be clearly understood that the example perforating gun illustrated by FIG. 10 is merely a general application of the principles of this disclosure in practice, and a wide variety of other examples are possible. Therefore, the scope of this disclosure is not limited in any manner to the details of FIG. 10 as described herein.

Figure 11:
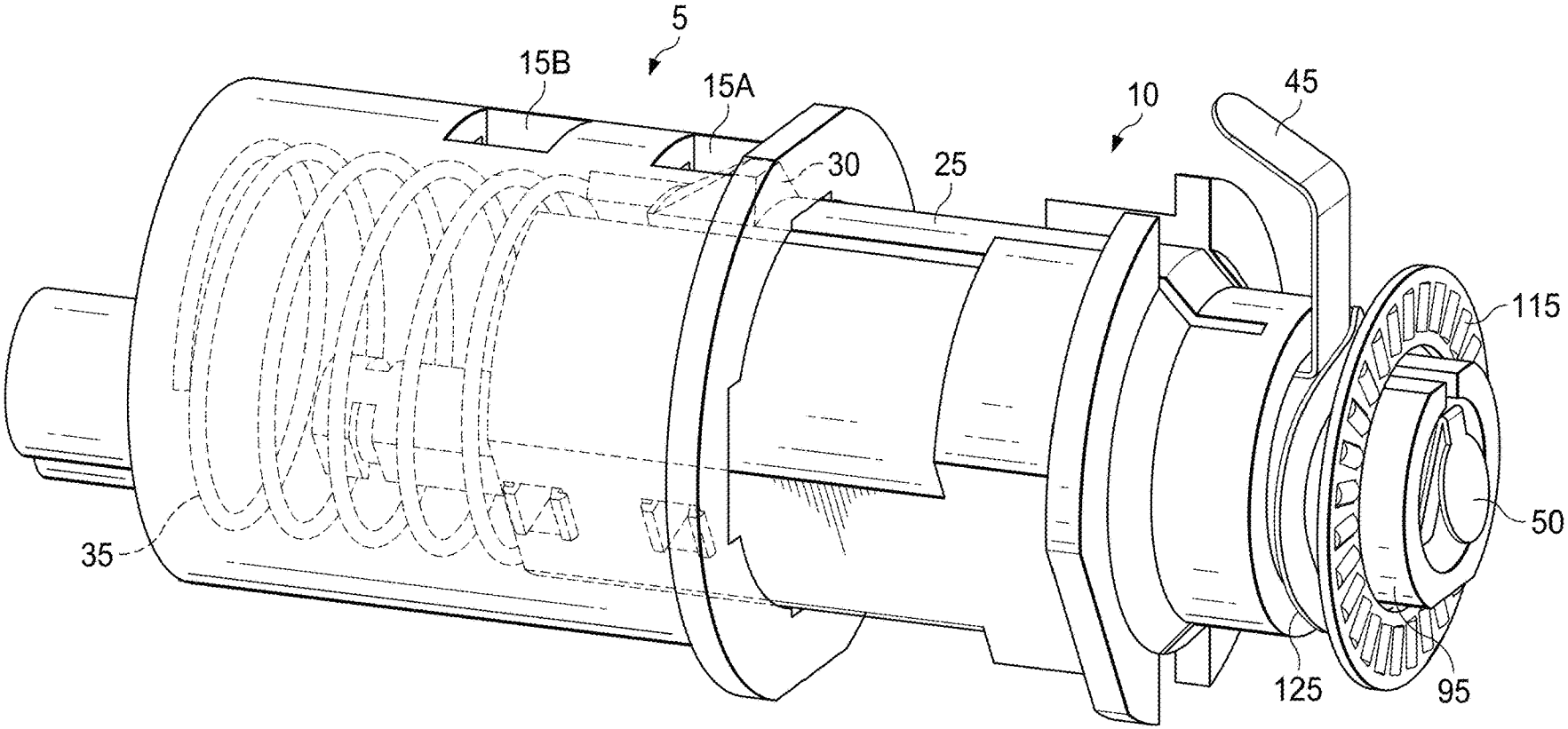
FIG. 11 is an illustration of the perforating gun when the secondary housing is installed within the primary housing in the disarmed configuration in accordance with one or more examples described herein.

FIG. 11 is an illustration of the perforating gun when the secondary housing 10 is installed within the primary housing 5 in the disarmed configuration. In this configuration, the protrusion 30 is slotted in cutout 15A and cutout 15B is empty. In this specific example, only one protrusion 30 is used on the flexing element 25 of the secondary housing 10. Additionally, a bearing 115 has been installed on bearing surface 95. The illustrated bearing is a thrust bearing, but other types of bearings may be used including, but not limited to, a needle bearing, angular contact bearing, journal bearing, taper roller bearing, roller bearing and the like. Optionally, a wave spring 175 was installed proximate bearing 115 and electrical ground 45. The wave spring 175 may provide a counterforce during insertion of the secondary housing 10 such that the force to compress the bearing 115 must be larger or smaller than the force required to compress the spring 35 in the primary housing 5. As such, the force needed to insert the secondary housing 10 in the primary housing 5 allows for the electrical connection with the electrical connector 50 to be established before the detonator and the detonating cord are coupled.

It should be clearly understood that the example perforating gun illustrated by FIG. 11 is merely a general application of the principles of this disclosure in practice, and a wide variety of other examples are possible. Therefore, the scope of this disclosure is not limited in any manner to the details of FIG. 11 as described herein.

Figure 12:
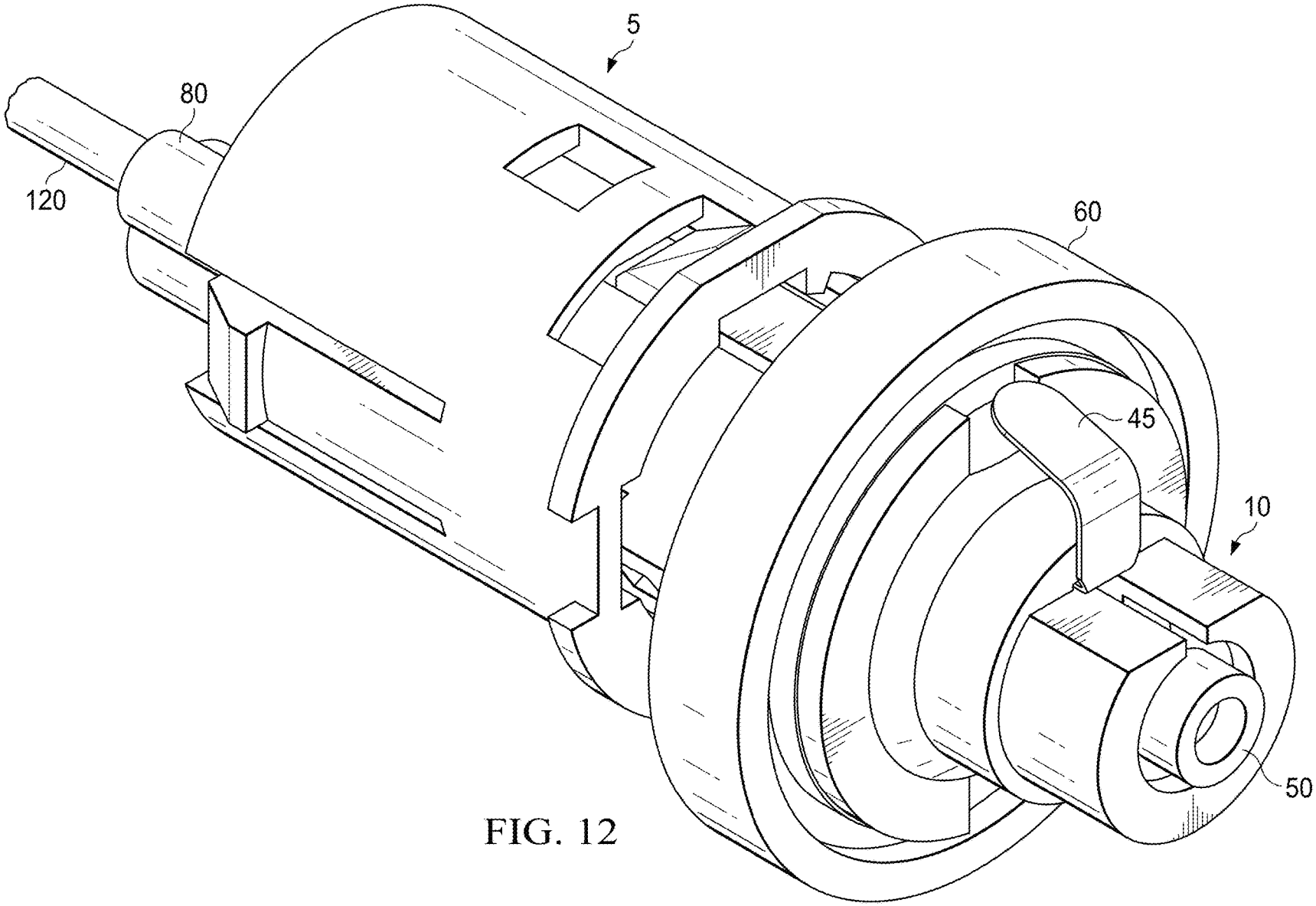
FIG. 12 is another illustration of the perforating gun when the secondary housing is installed within the primary housing in the disarmed configuration in accordance with one or more examples described herein.

FIG. 12 is another illustration of the perforating gun when the secondary housing 10 is installed within the primary housing 5 in the disarmed configuration. In this illustration, the detonating cord 120 has been inserted into the detonating cord insert tube 80. When the perforating gun is armed, the detonator (not illustrated) will couple to the detonating cord 120 within the perforating gun. Additionally, this specific example comprises a bearing 60 installed on a bearing surface (i.e., bearing surface 90 as seen in FIG. 6). This illustrated bearing is a standard roller bearing, but other types of bearings may be used in some examples. The electrical connector 50 and electrical ground 45 are also visible in this illustration. For this specific example, the electrical connector 50 is a crown spring electrical connector.

It should be clearly understood that the example perforating gun illustrated by FIG. 12 is merely a general application of the principles of this disclosure in practice, and a wide variety of other examples are possible. Therefore, the scope of this disclosure is not limited in any manner to the details of FIG. 12 as described herein.

Figure 13:
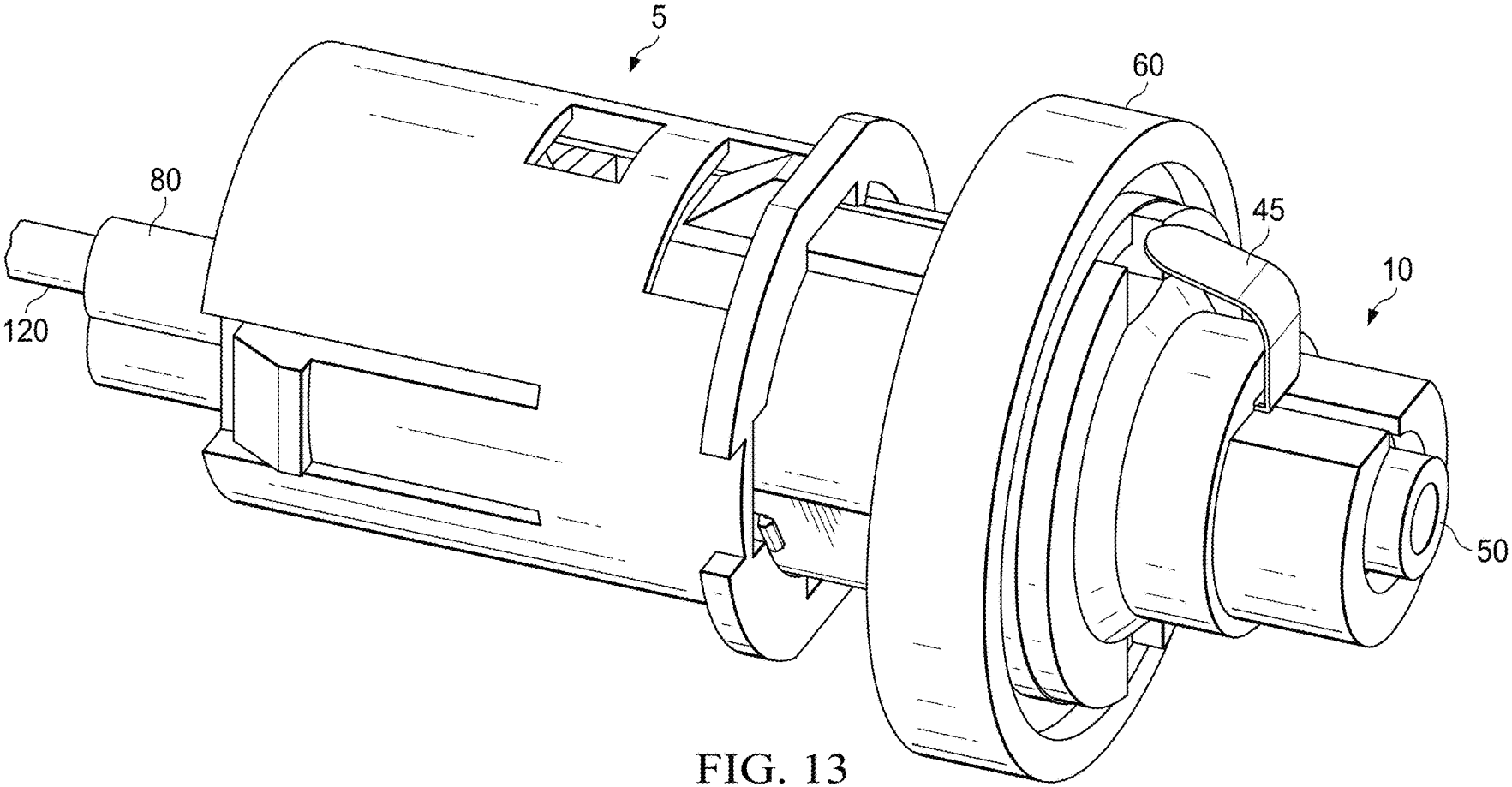
FIG. 13 is another illustration of the perforating gun of FIG. 12 in accordance with one or more examples described herein.

FIG. 13 is another illustration of the perforating gun of FIG. 12; however, the interior of the secondary housing 10 has been made transparent so as to better illustrate the crown spring electrical connector 50. The crown spring connector 50 may receive a mating or male electrical component to continue electrical communication to the next perforating gun. The crown spring connector 50 features, in this current illustration, a crimp connection to the switch, but can also comprise a solder, a male to female connection, or other joining methods for electrical connectors.

It should be clearly understood that the example perforating gun illustrated by FIG. 13 is merely a general application of the principles of this disclosure in practice, and a wide variety of other examples are possible. Therefore, the scope of this disclosure is not limited in any manner to the details of FIG. 13 as described herein.

Figure 14:
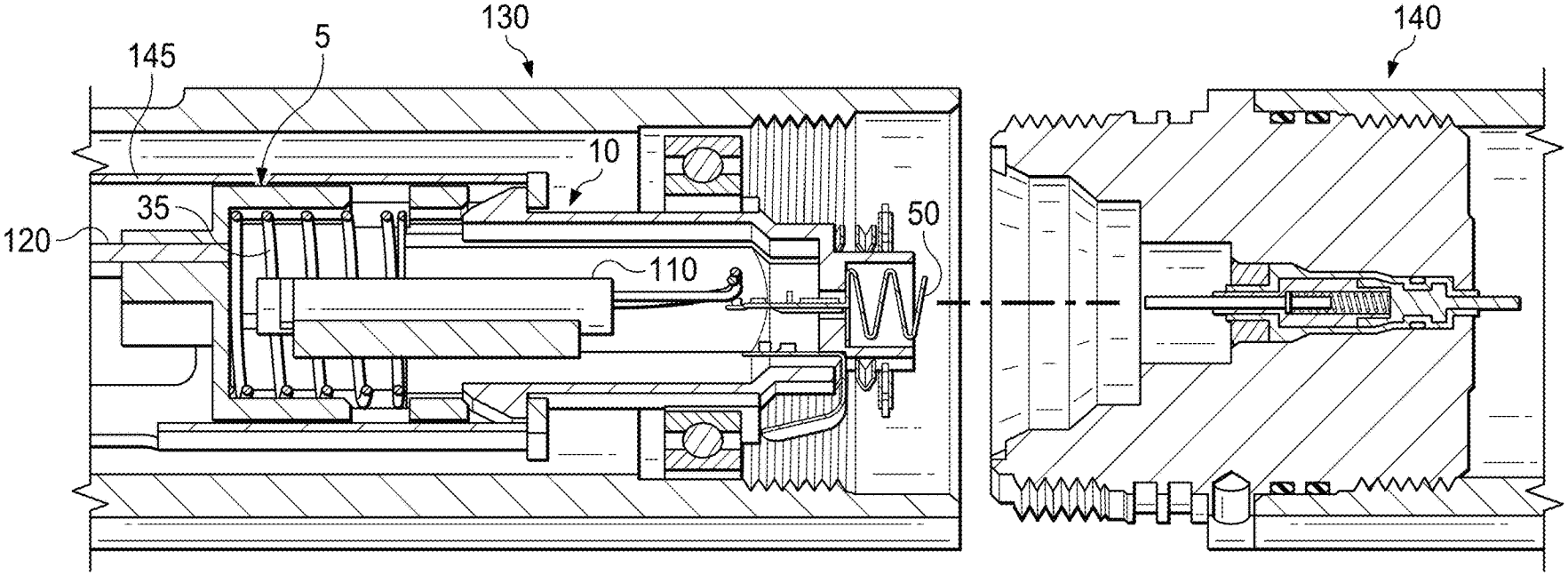
FIG. 14 is an illustration of a disarmed perforating gun prior to arming by pressure applied from a second perforating gun in accordance with one or more examples described herein.

FIG. 14 is an illustration of a disarmed perforating gun 130 prior to arming by pressure applied from a second perforating gun 140. In the illustrated example, the primary housing 5 has been installed within a charge tube 145. The secondary housing 10 is partially inserted into the primary housing 5. The detonator 40 is not in contact with the detonating cord 120. A second perforating gun 140 disposed within a bulkhead assembly may be placed proximate to the end of the secondary housing 10 comprising the electrical connector 50. The perforating gun 130 may be transported and/or stored when in a disarmed configuration.

It should be clearly understood that the example perforating gun illustrated by FIG. 14 is merely a general application of the principles of this disclosure in practice, and a wide variety of other examples are possible. Therefore, the scope of this disclosure is not limited in any manner to the details of FIG. 14 as described herein.

Figure 15:
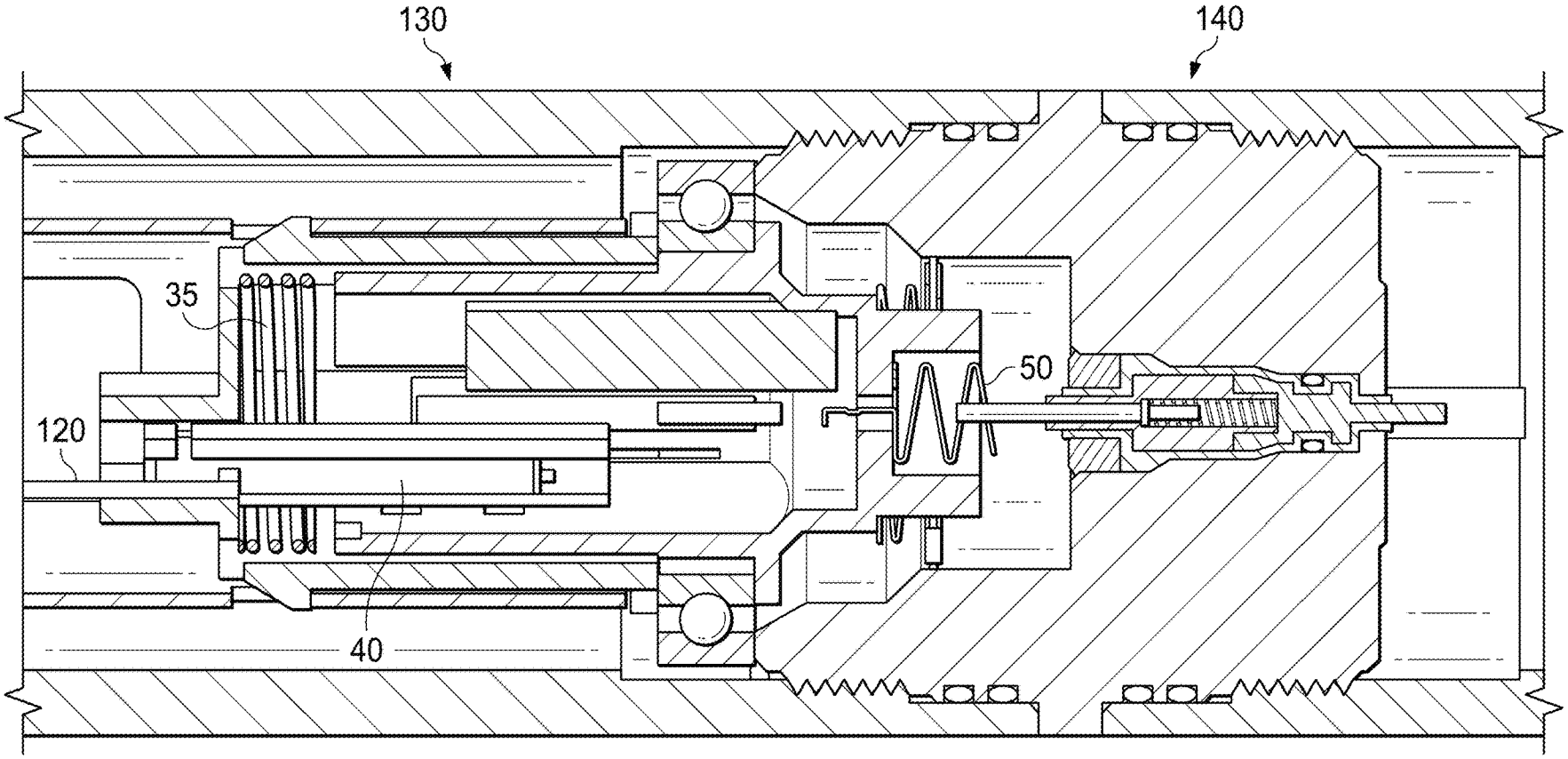
FIG. 15 is an illustration of an armed perforating gun after arming from force applied by the second perforating gun in accordance with one or more examples described herein.

FIG. 15 is an illustration of an armed perforating gun 130, which has been armed from force applied by the second perforating gun 140 by coupling the first perforating gun 130 to the second perforating gun 140. In the illustrated example, the secondary housing 10 is fully inserted into the primary housing 5 and spring 35 is compressed. Insertion of the secondary housing 10 was accomplished by axial force applied from second perforating gun 140. The detonator 40 contacts detonating cord 120. The second perforating gun 140 was used to apply pressure to the end of the secondary housing 10 comprising the electrical connector 50. The second perforating gun 140 couples to the electrical connector 50 and also has pushed the secondary housing 10 into the primary housing 5 until the protrusion(s) of the flexing element of the secondary housing 10 slots into the cutout of the primary housing that locks the first perforating gun 130 into the armed configuration as discussed above. In this configuration, the first perforating gun 130 is armed and may be fired when desired.

It should be clearly understood that the example perforating gun illustrated by FIG. 15 is merely a general application of the principles of this disclosure in practice, and a wide variety of other examples are possible. Therefore, the scope of this disclosure is not limited in any manner to the details of FIG. 15 as described herein.

In some alternative examples, a J-slot and lug may be used as a keyway so that the secondary housing is inserted and twisted to transition from disarmed to armed. Inversely, to disarm, the J-slot is twisted counter to the keyway and allows the spring to extend outwards thereby disconnect the detonator from the detonator cord. The J-slot and lug arrangement may be used in addition to or instead of the flexing element with protrusions and cutout arrangement discussed above. This arrangement implements a rotational action to the arming and disarming of the detonator. The rotation may incorporate the detonator housing in some examples. The detonator housing in this configuration may act as a ballistic transfer barrier while in the unarmed position. The rotational action may move the housing to align the unconfined area with the detonating cord in the mating housing.

The actions that are required to arm the detonator and perforating gun may be purposely manipulated by the design features and elements described in this disclosure. Arming actions such as making up the threaded connections of the guns, the axial compression of a spring, slotting components, and the rotational motion of a barrier element may be utilized to increase the safety and reliability of the explosive system.

The perforating gun disclosed herein may directly or indirectly affect one or more components or pieces of equipment associated with or which may come into contact with the perforating gun such as, but not limited to, wellbore casing, wellbore liner, completion string, insert strings, drill string, coiled tubing, slickline, wireline, drill pipe, drill collars, mud motors, downhole motors and/or pumps such as electric submersible pumps (ESPs), cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), jetting tools, sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

Provided are perforating guns in accordance with the disclosure and the illustrated FIGs. An example perforating gun comprises a primary housing and the primary housing comprises two cutouts along an axial length of the primary housing. The perforating gun further comprises a secondary housing comprising a flexing element and a spring and the secondary housing is configured to insert into the primary housing. The flexing element comprises a protrusion on an exterior surface of the flexing element and the protrusion comprises an angled surface and extends radially outward from the secondary housing. The protrusion is shaped to slot into one of the cutouts when the secondary housing is inserted into the primary housing. The protrusion slots into a first of the cutouts to disarm the perforating gun. The protrusion slots into a second of the cutouts to arm the perforating gun. The spring is disposed on an end of the secondary housing and presses against an interior surface of the primary housing when the secondary housing is inserted into the primary housing. The perforating gun additionally comprises a detonator coupled to an interior surface of the secondary housing.

Additionally, or alternatively, the perforating gun may include one or more of the following features individually or in combination. The protrusion may be shaped such that when the protrusion is slotted into a cutout, the protrusion prevents movement of the secondary housing in a direction opposite of the direction of insertion of the secondary housing. The protrusion may also be shaped such that when the protrusion is slotted into a cutout, the protrusion allows movement of the secondary housing in the direction of insertion of the secondary housing such that the secondary housing can be inserted deeper into the primary housing. The protrusion may be shaped such that when the protrusion is slotted into a cutout, the protrusion allows rotational movement of the secondary housing within the primary housing. The secondary housing may comprise a detonator housing that is one continuous piece with the secondary housing. The secondary housing may comprise a detonator housing that is a separate component from the secondary housing. The perforating gun may comprise a switch disposed within the primary housing. The flexing element may comprise a second protrusion. The secondary housing may further comprise an electrical ground. The secondary housing may further comprise a bearing on an exterior of the secondary housing.

Provided are methods for using a perforating gun in accordance with the disclosure and the illustrated FIGs. An example method comprises inserting a secondary housing into a primary housing until a protrusion on a flexing element of the secondary housing slots into a first cutout on the primary housing thereby forming a disarmed perforating gun. The primary housing comprises the first cutout and a second cutout along an axial length of the primary housing. The secondary housing comprises the flexing element and a spring. The protrusion comprises an angled surface and extends radially outward from the secondary housing. The spring is disposed on an end of the secondary housing and presses against an interior surface of the primary housing when the secondary housing is inserted into the primary housing. The perforating gun further comprises a detonator coupled to an interior surface of the secondary housing. The method further comprises arming the perforating gun by applying sufficient force to move the protrusion from the first cutout to the second cutout and firing the perforating gun.

Additionally, or alternatively, the method may include one or more of the following features individually or in combination. The method may further comprise applying a force to the secondary housing with a second perforating gun to insert the secondary housing into the primary housing. The method may further comprise transporting the perforating gun when the protrusion is inserted into the first cutout. The protrusion may be shaped such that when the protrusion is slotted into a cutout, the protrusion prevents movement of the secondary housing in a direction opposite of the direction of insertion of the secondary housing. The protrusion may also be shaped such that when the protrusion is slotted into a cutout, the protrusion allows movement of the secondary housing in the direction of insertion of the secondary housing such that the secondary housing can be inserted deeper into the primary housing. The protrusion may be shaped such that when the protrusion is slotted into a cutout, the protrusion allows rotational movement of the secondary housing within the primary housing. The secondary housing may comprise a detonator housing that is one continuous piece with the secondary housing. The secondary housing may comprise a detonator housing that is a separate component from the secondary housing. The perforating gun may comprise a switch disposed within the primary housing. The flexing element may comprise a second protrusion. The secondary housing may further comprise an electrical ground. The secondary housing may further comprise a bearing on an exterior of the secondary housing.

Provided are systems for perforating in a wellbore in accordance with the disclosure and the illustrated FIGs. An example system comprises a perforating gun comprising a primary housing. The primary housing comprises two cutouts along an axial length of the primary housing. The perforating gun comprises a secondary housing comprising a flexing element and a spring. The secondary housing is configured to insert into the primary housing. The flexing element comprises a protrusion on an exterior surface of the flexing element and the protrusion comprises an angled surface and extends radially outward from the secondary housing. The protrusion is shaped to slot into one of the cutouts when the secondary housing is inserted into the primary housing. The protrusion slots into a first of the cutouts to disarm the perforating gun. The protrusion slots into a second of the cutouts to arm the perforating gun. The spring is disposed on an end of the secondary housing and presses against an interior surface of the primary housing when the secondary housing is inserted into the primary housing. The perforating gun additionally comprises a detonator coupled to an interior surface of the secondary housing. The system further comprises a second perforating gun configured to apply a force to the secondary housing to insert the secondary housing into the primary housing.

Additionally, or alternatively, the system may include one or more of the following features individually or in combination. The protrusion may be shaped such that when the protrusion is slotted into a cutout, the protrusion prevents movement of the secondary housing in a direction opposite of the direction of insertion of the secondary housing. The protrusion may also be shaped such that when the protrusion is slotted into a cutout, the protrusion allows movement of the secondary housing in the direction of insertion of the secondary housing such that the secondary housing can be inserted deeper into the primary housing. The protrusion may be shaped such that when the protrusion is slotted into a cutout, the protrusion allows rotational movement of the secondary housing within the primary housing. The secondary housing may comprise a detonator housing that is one continuous piece with the secondary housing. The secondary housing may comprise a detonator housing that is a separate component from the secondary housing. The perforating gun may comprise a switch disposed within the primary housing. The flexing element may comprise a second protrusion. The secondary housing may further comprise an electrical ground. The secondary housing may further comprise a bearing on an exterior of the secondary housing.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A perforating gun comprising:

a primary housing; wherein the primary housing comprises two cutouts along an axial length of the primary housing;

a secondary housing comprising a flexing element and a spring; wherein the secondary housing is configured to insert into the primary housing; wherein the flexing element comprises a protrusion on an exterior surface of the flexing element and wherein the protrusion comprises an angled surface and extends radially outward from the secondary housing; wherein the protrusion is shaped to slot into one of the cutouts when the secondary housing is inserted into the primary housing; wherein the protrusion slots into a first of the cutouts to disarm the perforating gun; wherein the protrusion slots into a second of the cutouts to arm the perforating gun; wherein the spring is disposed on an end of the secondary housing and presses against an interior surface of the primary housing when the secondary housing is inserted into the primary housing; and a detonator coupled to an interior surface of the secondary housing.

2. The perforating gun of claim 1, wherein the protrusion is shaped such that when the protrusion is slotted into a cutout, the protrusion prevents movement of the secondary housing in a direction opposite of the direction of insertion of the secondary housing; wherein the protrusion is shaped such that when the protrusion is slotted into a cutout, the protrusion allows movement of the secondary housing in the direction of insertion of the secondary housing such that the secondary housing can be inserted deeper into the primary housing.

3. The perforating gun of claim 1, wherein the protrusion is shaped such that when the protrusion is slotted into a cutout, the protrusion allows rotational movement of the secondary housing within the primary housing.

4. The perforating gun of claim 1, wherein the secondary housing comprises a detonator housing that is one continuous piece with the secondary housing.

5. The perforating gun of claim 1, wherein the secondary housing comprises a detonator housing that is a separate component from the secondary housing.

6. The perforating gun of claim 1, wherein the perforating gun comprises a switch disposed within the primary housing.

7. The perforating gun of claim 1, wherein the flexing element comprises a second protrusion.

8. The perforating gun of claim 1, wherein the secondary housing further comprises an electrical ground.

9. The perforating gun of claim 1, wherein the secondary housing further comprises a bearing on an exterior of the secondary housing.

10. A method for using a perforating gun, the method comprises:

inserting a secondary housing into a primary housing until a protrusion on a flexing element of the secondary housing slots into a first cutout on the primary housing thereby forming a disarmed perforating gun;

wherein the primary housing comprises the first cutout and a second cutout along an axial length of the primary housing;

wherein the secondary housing comprises the flexing element and a spring; wherein the protrusion comprises an angled surface and extends radially outward from the secondary housing; wherein the spring is disposed on an end of the secondary housing and presses against an interior surface of the primary housing when the secondary housing is inserted into the primary housing;

wherein the perforating gun further comprises a detonator coupled to an interior surface of the secondary housing;

arming the perforating gun by applying sufficient force to move the protrusion from the first cutout to the second cutout; and firing the perforating gun.

11. The method of claim 10, wherein a second perforating gun applies a force to the secondary housing to insert the secondary housing into the primary housing.

12. The method of claim 10, further comprising transporting the perforating gun when the protrusion is inserted into the first cutout.

13. The method of claim 10, wherein the protrusion is shaped such that when the protrusion is slotted into a cutout, the protrusion prevents movement of the secondary housing in a direction opposite of the direction of insertion of the secondary housing; wherein the protrusion is shaped such that when the protrusion is slotted into a cutout, the protrusion allows movement of the secondary housing in the direction of insertion of the secondary housing such that the secondary housing can be inserted deeper into the primary housing.

14. The method of claim 10, wherein the protrusion is shaped such that when the protrusion is slotted into a cutout, the protrusion allows rotational movement of the secondary housing within the primary housing.

15. The method of claim 10, wherein the secondary housing comprises a detonator housing that is one continuous piece with the secondary housing.

16. The method of claim 10, wherein the secondary housing comprises a detonator housing that is a separate component from the secondary housing.

17. A system for perforating in a wellbore, the system comprises:

a perforating gun comprising:

a primary housing; wherein the primary housing comprises two cutouts along an axial length of the primary housing;

a secondary housing comprising a flexing element and a spring; wherein the secondary housing is configured to insert into the primary housing; wherein the flexing element comprises a protrusion on an exterior surface of the flexing element and wherein the protrusion comprises an angled surface and extends radially outward from the secondary housing; wherein the protrusion is shaped to slot into one of the cutouts when the secondary housing is inserted into the primary housing; wherein the protrusion slots into a first of the cutouts to disarm the perforating gun; wherein the protrusion slots into a second of the cutouts to arm the perforating gun; wherein the spring is disposed on an end of the secondary housing and presses against an interior surface of the primary housing when the secondary housing is inserted into the primary housing; and a detonator coupled to an interior surface of the secondary housing; and a second perforating gun configured to apply a force to the secondary housing to insert the secondary housing into the primary housing.

18. The system of claim 16, wherein the protrusion is shaped such that when the protrusion is slotted into a cutout, the protrusion prevents movement of the secondary housing in a direction opposite of the direction of insertion of the secondary housing; wherein the protrusion is shaped such that when the protrusion is slotted into a cutout, the protrusion allows movement of the secondary housing in the direction of insertion of the secondary housing such that the secondary housing can be inserted deeper into the primary housing.

19. The system of claim 16, wherein the protrusion is shaped such that when the protrusion is slotted into a cutout, the protrusion allows rotational movement of the secondary housing within the primary housing.

20. The system of claim 16, wherein the flexing element comprises a second protrusion.

* * * * *